United States Patent [19]

Wood et al.

[11] Patent Number: 4,811,554

[45] Date of Patent: Mar. 14, 1989

[54] FRICTION SPINNING APPARATUS

[75] Inventors: Alfred Wood, Greater Manchester; Robert Lane, Accrington, both of England

[73] Assignee: Hollingsworth (U.K.) Ltd., Accrington, United Kingdom

[21] Appl. No.: 150,116

[22] Filed: Jan. 29, 1988

[30] Foreign Application Priority Data

Feb. 6, 1987 [GB] United Kingdom ..... 8702723

[51] Int. Cl.[4] ..... D01H 1/12; D01H 1/135

[52] U.S. Cl. ..... 57/401

[58] Field of Search ..... 57/400, 401, 404, 406, 57/408, 411, 263

[56] References Cited

U.S. PATENT DOCUMENTS 4,165,600 8/1979 Schippors et al. ..... 57/401
4,168,601 9/1979 Didek et al. ..... 57/401
4,241,571 12/1980 Turk et al. ..... 57/401
4,241,574 12/1980 Turk et al. ..... 57/401 X
4,676,062 6/1987 Brockmanns et al. ..... 57/401 X
4,753,066 6/1988 Briner et al. ..... 57/401

*Primary Examiner*—Donald Watkins
*Attorney, Agent, or Firm*—Cort Flint

[57] ABSTRACT

A friction spinning unit employs two rotatable bodies to define the spinning gap, at least one of the bodies being in the form of a cone whose surface moves towards the friction spinning gap from the same side as that from which separated fibres are fed by a fibre feed means. This configuration of the bodies generates a self-conveying action which propels the bundle of fibres axially along the friction spinning gap so that the bundle itself enters twist-blocking means which facilitates the piecing action and dispenses with the need for a seed yarn to be returned to the friction spinning gap to piece up after a yarn break or after shutdown.

17 Claims, 3 Drawing Sheets

FRICTION SPINNING APPARATUS

FIELD OF THE INVENTION

The present invention relates to an improved form of friction spinning apparatus.

PRIOR ART

In the past friction spinning on a practical scale has been carried out using either cylindrical rollers or hyperboloidal waisted rollers which together define a yarn formation line on which fibres become rolled up to form a yarn.

It is known that to some extent self-conveying of the yarn being spun can be achieved when using hyperboloidal rollers, or in cruder forms of friction spinning units where crossed perforated suction belts are arranged so that each has a component of movement along the yarn formation line.

OBJECTS OF THE INVENTION

It is an object of the present invention to provide a novel form of friction spinning apparatus taking advantage of the possibility of self-conveying of the fibre bundle along the yarn formation line.

SUMMARY OF THE INVENTION

Accordingly, a first aspect of the present invention provides friction spinning apparatus including two rotatable bodies arranged side-by-side so as to have a line of closest approach between their surfaces, one of said bodies being a cone; means for feeding fibres to the line of closest approach between the two bodies nearer the end of said line of closest approach which is adjacent the narrower end of said cone; and means for withdrawing spun yard from the line of closest approach near its end at which the wider end of said cone occurs.

Another aspect of the present invention provides friction spinning apparatus including two conical bodies arranged side-by-side so as to have a line of closest approach, with the narrower end of one body adjacent the wider end of the other body, and vice versa, means for feeding fibres to the line of closest approach between the two bodies; and means for withdrawing spun yarn from the line of closest approach.

A third aspect of the invention provides friction spinning apparatus comprising two frusto-conical bodies of equal conicity arranged closely adjacent one another to define a friction spinning gap adjacent a line of closest approach of the bodies; parallel rotatable shafts carrying said bodies, common drive means for rotating said shafts in the same direction of rotation; fibre feed means for feeding separated fibres toward said friction spinning gap to form a rotating bundle of fibres at the friction spinning gap; and twist blocking yarn withdrawal means arranged to withdraw spun yarn along said friction spinning gap.

Preferably the frusto-conical bodies are of equal length and are driven at the same rotational speed.

More preferably, a pneumatic influence may be use to attract fibres towards the line of closest approach. One form of this pneumatic influence may involve feeding the fibres from one side of the plane joining the parallel axes of rotation of the two bodies, with the one body whose surface at said side rotates towards the line of closest approach perforated and having suction applied from within. Another possibility is for a suction nozzle to be positioned on the opposite side of said plane joining the parallel axes of rotation and then, as air passes through the gap between the two bodies at said line of closest approach, the fibres become blocked from going through said gap and are rotated to roll up into a bundle to form a yarn.

Conveniently the fibre feed means may comprise a sliver drafting system or a sliver-opening roller having teeth or pins on its periphery.

The direction of fibre feed may be such that the fibres land on the surface of said one body, so that the fibres are carried towards the line of closest approach on said surface. Alternatively, the fibres may be directed so that they land on or near the line of closest approach.

A further aspect of the present invention provides a process for starting up friction spinning, comprising accelerating the friction spinning surfaces of apparatus which effects self-conveying of fibres along the yarn formation line, relying on the natural self-conveying action to convey the rotating bundle of fibres along a yarn formation line without first introducing a seed yarn along the yarn formation line, and allowing the leading end of the said rotating fibre bundle to advance unguided so as to come under the influence of twist-blocking and yarn conveying means to assist winding up, as spun yarn, the bundle of fibres emerging parallel to the line of closest approach.

Preferably the yarn conveying means and the twist blocking means may be integral, for example where the yarn conveying means comprise nip rollers.

The fibre feed means may comprise a drafting system or a beater roller.

The friction surfaces may be the surface of cones arranged adjacent one another with the narrow end of one of the cones adjacent the wider end of the other.

Means may be provided for attracting the delivered separated fibres to the line of closest approach, for example by suction attraction towards the line of closest approach, or by suction or electrostatic attraction onto said cone surface which moves towards the line of closest approach between the cones.

BRIEF DESCRIPTION OF THE DRAWINGS

In order that the present invention may more readily be understood the following description is given, merely by way of example, with reference to the accompanying drawing in which.

DESCRIPTION OF THE PREFERRED EMBODIMENTS

Figure 1:
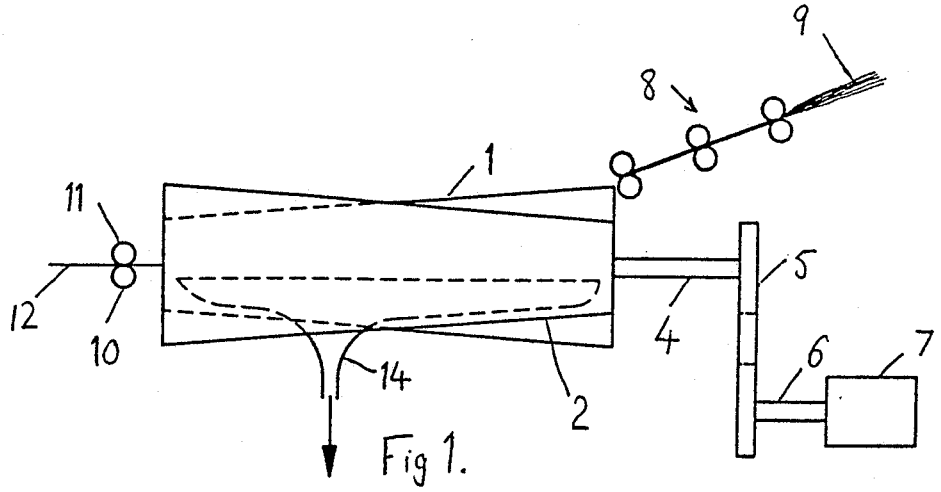
FIG. 1 shows a side elevation of a friction spinning device in accordance with the present invention.
Figure 2:
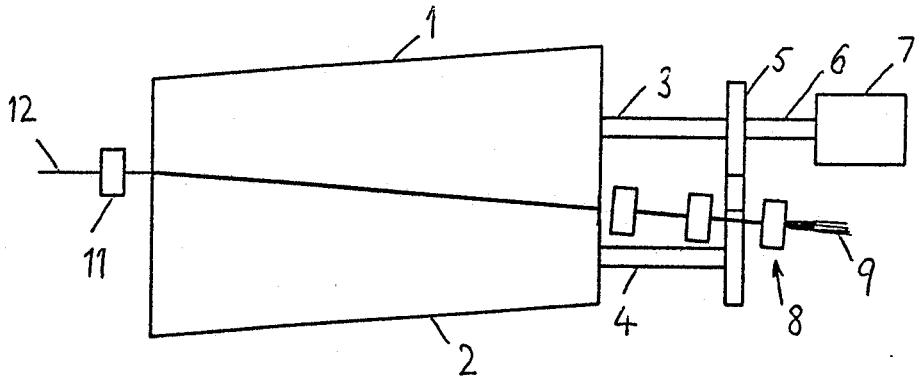
FIG. 2 is a plan view of the device of FIG. 1.
Figure 3:
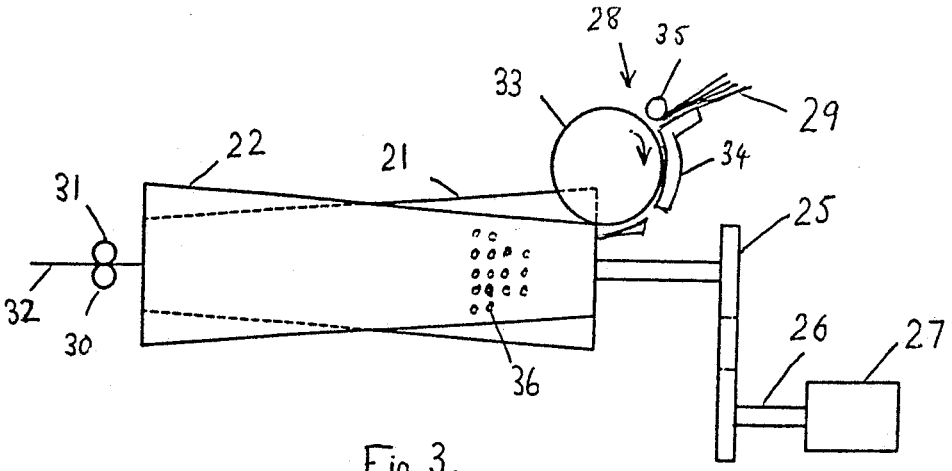
FIG. 3 is a side elevational view of a second embodiment of the apparatus including a toothed fibre-separating roller as the means for delivering separated fibres to the yarn formation line.
Figure 4:
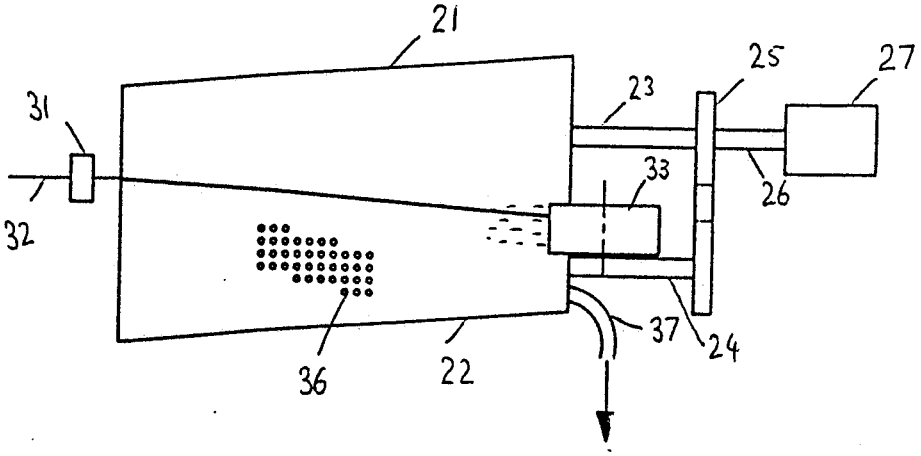
FIG. 4 is a top plan view of the apparatus of FIG. 3.
Figure 5:
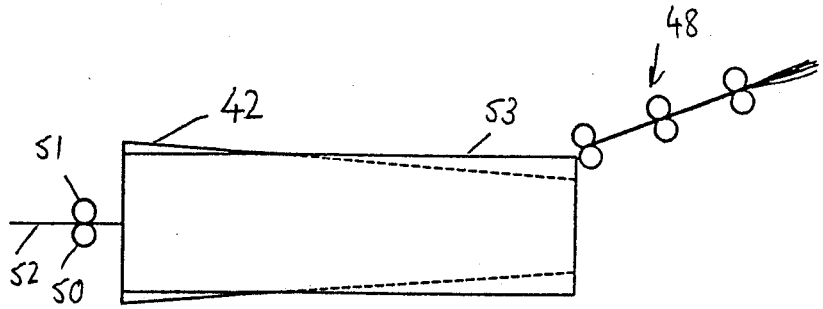
FIG. 5 is a side elevational view of an alternative embodiment of the friction spinning apparatus in which one of the rotatable bodies in a cylinder and the other is a cone.
Figure 6:
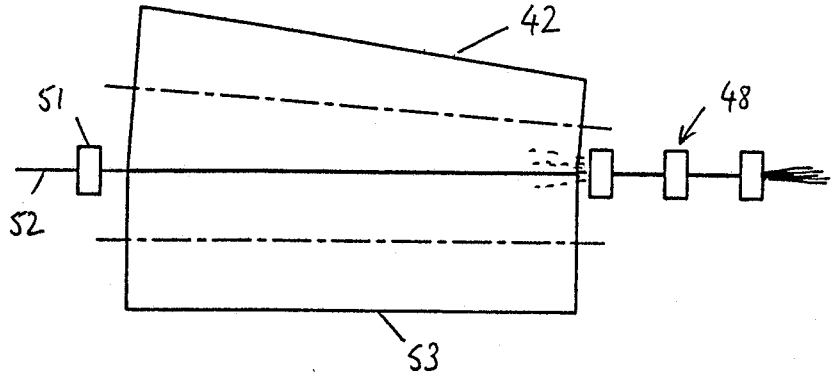
FIG. 6 is a top plan view of the apparatus of FIG. 5.

Referring now to FIGS. 1 and 2, there can be seen a pair of cones 1, 2, in this case of equal conicity, arranged so that they have a line of closest approach at a gap where the cones almost touch one another but so that the narrower end of one cone lies adjacent the wider end of the second cone, and vice versa.

The two cones are mounted on parallel respective shafts 3 and 4 which have a pair of pulleys drivingly linked by a drive belt 5 which also passes over a pulley on the end of the output shaft 6 of an electric motor 7. Although not shown in FIGS. 1 and 2, the configuration of the pulleys on the shafts 3 and 4 and the drive pulley on the shaft 6 is such that the centres of the three pulleys lie at the corners of a triangle. The pulleys on shafts 3 and 4 may be of equal diameter, in which case the triangle may be an isosceles triangle whose equal sides are the ones which meet at the centre of the pulley on the motor shaft 6. It may be preferable for the pulleys on shafts 3 and 4 to be of different diameters to result in different angular velocities of the cones 1, 2.

Fibre-separating means, in this case in the form of a drafting system 8, opens a sliver 9 to provide a stream of individual fibres which are projected directly onto the yarn formation line defined by the line of closest approach between the two cones 1 and 2, if required by means of a fibre feed duct having a, preferably rectilinear, longitudinal delivery slot very close to the line of closest approach.

We claim:

1. In friction spinning apparatus including:

(a) first and second rotatable bodies arranged side-by-side so as to have a line of closest approach with first and second ends, said first rotatable body being conical and having a narrower first end and a wider second end, said first end of said line of closest approach being adjacent said first end of said first rotatable body;

(b) means for feeding fibres to said line of closest approach adjacent the first end of said line of closest approach; and (b) means adjacent said second end of said line of closest approach for withdrawing spun yarn from said line of closest approach;

the improvement wherein there are no means for feeding an end of a spun yarn back onto the line of closest approach from said other end for piecing purposes.

2. In friction spinning apparatus including:

(a) first and second conical bodies arranged side-by-side so as to have a line of closest approach having first and second ends, each of said first and second bodies having narrower and wider end, and the narrower end of said first body being adjacent the wider end of said second body;

(b) means for feeding fibres to said line of closest approach; and (c) means adjacent the second end of said line of closest approach for withdrawing spun yarn from said line of closest approach;

the improvement wherein there are no means for feeding a spun yarn end back towards said line of closest approach from said second end thereof for piecing.

3. In friction spinning apparatus comprising:

(a) first and second frusto-conical bodies of equal conicity arranged closely adjacent one another to define a line of closest approach and a friction spinning gap adjacent said line of closest approach of the bodies, said friction spinning gap having first and second ends;

(b) first and second parallel rotatable shafts carrying said first and second bodies respectively;

(c) common drive means for rotating said first and second shafts in the same direction of rotation;

(d) fibre feed means for feeding separated fibres towards said friction spinning gap to form a rotating bundle of fibres at the friction spinning gap; and (e) twist-blocking yarn withdrawal means operative to withdraw spun yarn along said friction spinning gap from the second end thereof;

the improvement wherein there are no means for feeding a spun yarn end back towards the friction spinning gap at said second end for piecing.

4. Apparatus according to claim 3, wherein said first and second frusto-conical bodies are of equal length, said drive means are effective to and drive said first and second frusto-conical bodies at a common rotational speed.

5. Apparatus according to claim 1, wherein said second rotatably body is a cylinder.

6. Apparatus according to claim 1, wherein aid fibre feeding means feeds the fibres from one side of the plane joining the axes of rotation of said first and second bodies; wherein said first rotatable body has a perforated surface and rotates such that at said side, said perforated surface thereof moves towards the line of closest approach; and including means applying suction through said perforated surface from within.

7. Apparatus according to claim 1, wherein said first and second rotatably bodies have axes of rotation lying in a common plane, and wherein said fibre feed means feeds fibres from one side of said common plane; and including a suction nozzle positioned on the opposite side of said common plane and arranged so that as air passes through the gap between said first and second bodies at said line of closest approach the fibres become blocked from going through said gap and are rotated to roll up into a bundle to form a yarn.

8. Apparatus according to claim 2, wherein said fibre feeding means feeds the fibres from one side of the plane joining the axes of rotation of said first and second bodies; wherein said first rotatable body has a perforated surface and rotates such that at said side, said perforated surface thereof moves towards the line of closest approach; and including means applying suction through said perforated surface from within.

9. Apparatus according to claim 2, wherein said first and second rotatable bodies have axes of rotation lying in a common plane, and wherein said fibre feed means feeds fibres from one side of said common plane; and including a suction nozzle positioned on the opposite side of said common plane and arranged so that as air passes through the gap between said first and second bodies at said line of closest approach the fibres become blocked from going through said gap and are rotated to roll up into a bundle to form a yarn.

10. Apparatus according to claim 3, wherein said fibre feeding means feeds the fibres from one side of the plane joining the axes of rotation of said first and second bodies; wherein said first rotatable body has a perforated surface and rotates such that at said side, said perforated surface thereof moves towards the line of closest approach; and including means applying suction through said perforated surface from within.

11. Apparatus according to claim 3, wherein said first and second rotatable bodies have axes of rotation lying in a common plane, and wherein said fibre feed means feeds fibres from one side of said common plane; and including a suction nozzle positioned on the opposite side of said common plane and arranged so that as air passes through the gap between said first and second bodies of said line of closest approach the fibres become blocked from going through said gap and are rotated to roll up into a bundle to form a yarn.

12. Apparatus according to claim 5, wherein the fibre feed means comprises a sliver drafting system.

13. Apparatus according to claim 1, wherein said fibre feed means comprises a sliver-opening roller having on its periphery one of the group comprising teeth and pins.

14. Apparatus according to claim 2, wherein the fibre feed means comprises a sliver drafting system.

15. Apparatus according to claim 3, wherein the fibre feed means comprises a sliver drafting system.

16. Apparatus according to claim 1, wherein the fibre feed means directs the fibres to land on the surface of said first body, so that the fibres are carried towards said line of closest approach on said surface.

17. Apparatus according to claim 1, wherein the fibre feed means directs the fibres so that they land on or near said line of closest approach.

* * * * *